US010612224B2

(12) United States Patent
Peng et al.

(10) Patent No.: US 10,612,224 B2
(45) Date of Patent: Apr. 7, 2020

(54) DRAIN VALVE

(71) Applicant: WDI (XIAMEN) TECHNOLOGY INC., Xiamen (CN)

(72) Inventors: Jinxing Peng, Xiamen (CN); Youfen Chen, Xiamen (CN)

(73) Assignee: WDI (Xiamen) Technology Inc., Xiamen, Fujian (CN)

( * ) Notice: Subject to any disclaimer, the term of this patent is extended or adjusted under 35 U.S.C. 154(b) by 0 days.

(21) Appl. No.: 16/078,048

(22) PCT Filed: Oct. 13, 2016

(86) PCT No.: PCT/CN2016/101993

§ 371 (c)(1),
(2) Date: Aug. 21, 2018

(87) PCT Pub. No.: WO2017/161864

PCT Pub. Date: Sep. 28, 2017

(65) Prior Publication Data

US 2019/0048569 A1 Feb. 14, 2019

(30) Foreign Application Priority Data

Mar. 23, 2016 (CN) ..... 2016 1 0170006

(51) Int. Cl.
*E03D 1/35* (2006.01)

(52) U.S. Cl.
CPC ..... *E03D 1/35* (2013.01)

(58) Field of Classification Search
CPC ..... E03D 1/35
USPC ..... 4/392
See application file for complete search history.

(56) References Cited

FOREIGN PATENT DOCUMENTS

CN 203891162 U * 10/2014

OTHER PUBLICATIONS

English Machine translation of CN203891162 U printed Sep. 19, 2019 (Year: 2014).*

* cited by examiner

*Primary Examiner* — Christine J Skubinna
(74) *Attorney, Agent, or Firm* — Rosenberg, Klein & Lee

(57) ABSTRACT

A drain valve includes a valve body provided with a drain outlet in the lower portion, a first valve element arranged in the valve body to open or close the drain outlet, dividing the valve body into an inner cavity and an outer cavity and provided with a water outlet communicated with the drain outlet, a second valve element located in the inner cavity to open or close the water outlet of the first valve element, and a lifting component having an end connected with the second valve element and provided with a floating body assisting the lifting component in lifting the second valve element with a buoyancy force. Compared with traditional drain valves, the drain valve realizes the same draining effect with a short lift stroke, is convenient and fast to use, and improves the comfort level for users.

9 Claims, 3 Drawing Sheets

DRAIN VALVE

BACKGROUND OF THE INVENTION

Technical Field

The invention relates to the field of bathroom accessories, in particular to a drain valve.

Description of Related Art

In modern society, flush toilets have been widely applied to the daily life of people. Drain valves are disposed in water tanks of toilets to be used for draining and flushing. When traditional drain valves typically of a lever-type structure are used, the lever mechanism is made to work to lift a pull rod by pushing a button or by rotating a handle, and then, the valve element is opened to discharge water. The lift stroke of the drain valves of this structure is large and is generally about 20 mm. For instance, as for a 3-inch drain valve with a large valve element, the lift stroke may be very long, which makes it difficult for users to push the button or to rotate the handle, consequentially, decreasing the comfort level.

BRIEF SUMMARY OF THE INVENTION

In order to solve the above-mentioned problems and to overcome the defects of the prior art, the invention provides a drain valve. The drain valve includes:

a valve body, wherein a drain outlet is formed in the lower portion of the valve body;

a first valve element, wherein the first valve element is arranged in the valve body and used to open or close the drain outlet, divides the valve body into an inner cavity and an outer cavity, and is provided with a water outlet communicated with the drain outlet;

a second valve element, wherein the second valve element is located in the inner cavity and used to open or close the water outlet of the first valve element; and a lifting component, wherein the lifting component has an end connected with the second valve element and is provided with a floating body, and with the assistance of the buoyancy force of the floating body, the lifting component lifts the second valve element.

Through this configuration, the inner cavity is basically closed, and thus, when the drain valve is in a closed static state, the water pressure in the inner cavity is equal to the pressure outside the cavity.

Preferably, the first valve element is a hollow part, and as long as the first valve element can divide the interior of the valve body into the basically-closed inner cavity and the outer cavity when moving upwards and downwards in the valve body, the first valve element can be in various shapes such as hollow taper shape, a bowl shape or a T shape.

Furthermore, the lifting component is lifted to drive the second valve element to move to a first opening position to open the water outlet from a first closing position for initially closing the water outlet, then water in the inner cavity is discharged, the downward water pressure borne by the second valve element is decreased accordingly, and thus, the second valve element automatically rises to a limit height under the buoyancy force of the floating body; when water in the inner cavity is discharged, the downward water pressure borne by the first valve element is also decreased, so that the first valve element automatically floats upwards to a second opening position to completely open the drain outlet from a second closing position for initially closing the drain outlet, and thus, water in the drain valve is discharged.

The maximum lift stroke h of the second valve element from the first closing position to the first opening position is smaller than the maximum stroke H of the first valve element from the second closing position to the second opening position.

The buoyancy force of the floating body is greater than the gravity of the lifting component and the second valve element in water and smaller than the resultant force of the gravity and water pressure borne by the lifting component and the second valve element when the water outlet is closed.

Furthermore, the side wall of the valve body is provided with a drain window through which water outside the valve body is communicated with the outer cavity. When the first valve element floats upwards to open the drain outlet, water outside the valve body flows out of the drain outlet via the drain window.

Furthermore, the inner cavity is provided with a water supply channel allowing water outside the inner cavity to enter the inner cavity.

Furthermore, the water supply channel is a gap between the first valve element and the side wall of the valve body. Water outside the valve body enters the valve body via the drain window and then enters the inner cavity via the gap.

Through this configuration, on the one hand, when the drain valve is in the closed static state, the second valve element bears a downward resultant force of the upward buoyancy force of the floating body, the downward water pressure in the inner cavity, the gravity of the lifting component and the gravity of its own to close the water outlet, and the first valve element closes the drain outlet under the effect of the pressure in the inner cavity and the gravity of its own; when the second valve element is lifted to the first opening position, water in the inner cavity is rapidly discharged, and water in an external water tank passes through the drain window and the water supply channel to enter the inner cavity; and as the draining speed is much higher than the inflow speed, the pressure in the inner cavity is rapidly decreased, the downward force borne by the second valve element is drastically decreased accordingly, the buoyancy force of the floating body is greater than the gravity of the lifting component and the second valve element in water, and thus, the second valve element bears a large upward resultant force to automatically float upwards to a limit height. On the other hand, after the second valve element is opened, water in the inner cavity is rapidly discharged via the drain outlet, the water pressure, applied to the upper surface of the first valve element, in the inner cavity is rapidly decreased, the original balanced water pressure state of the inner cavity and the outer cavity is broken, and under the effect of an upward resultant force of the upward water pressure from the outer cavity and the buoyancy force, the first valve element overcomes the gravity of its own to automatically float upwards to open the drain outlet of the valve body and to reach the maximum opening height H. In this way, the lift stroke h for the first valve element to reach the set opening height H to open the drain outlet is much smaller than that of traditional drain valves (as for the lift stroke of the traditional drain valves, H=h), and thus, the drain valve can be used by users more conveniently.

Preferably, the floating body is in a blow shape open downwards or is made of light foam.

Through this configuration, the floating body has a large buoyancy force in water under the effect of air left in the floating body.

Preferably, the lifting component is in a rod shape, the top of the valve body is provided with a through hole, and the rod portion of the lifting component stretches out of the through hole.

Preferably, the top of the valve body is provided with a plurality of water holes allowing water outside the valve body to enter the inner cavity.

Through this configuration, the inflow speed of water outside the valve body into the inner cavity can be regulated. Water outside the valve body enters the inner cavity through the water supply channel as well as through the water holes and the through hole, matched with the rod-shaped lifting component, in the top of the valve body. The water supply speed to the inner cavity can be accordingly regulated by adjusting the number, size, distribution and the like of the water holes.

Preferably, H is 20-30 mm, and h is 4-10 mm.

The actual value of H can be adjusted according to the structural size of the drain valve as long as the drain outlet can be completely opened when the first valve element is lifted. Similarly, the actual value of h can be adjusted by designers according to the structure of the drain valve.

Furthermore, a first sealing element is arranged on the outer side wall of the first valve element and used to seal the drain outlet, and a second sealing element is arranged on the outer side wall of the second valve element and used to seal the water outlet.

The first sealing element and the second sealing element are rubber gaskets.

Compared with traditional drain valves, the drain valve of the invention realizes the same draining effect with a short lift stroke, is convenient and fast to use, and improves the comfort level for users.

DETAILED DESCRIPTION OF THE INVENTION

To make the objective, technical scheme and advantages of the invention clearer, a detailed illustration of the embodiments of the invention is given in combination with the drawings as follows. However, those ordinarily skilled in this field would appreciate that various technical details for readers to better understand the application are presented in the embodiments of the invention, but even without these technical details, the technical scheme claiming for protection by the claims of the application can still be realized based on various variations and modifications of the following embodiments.

The invention is introduced in combination with the drawings as follows.

Figure 1:
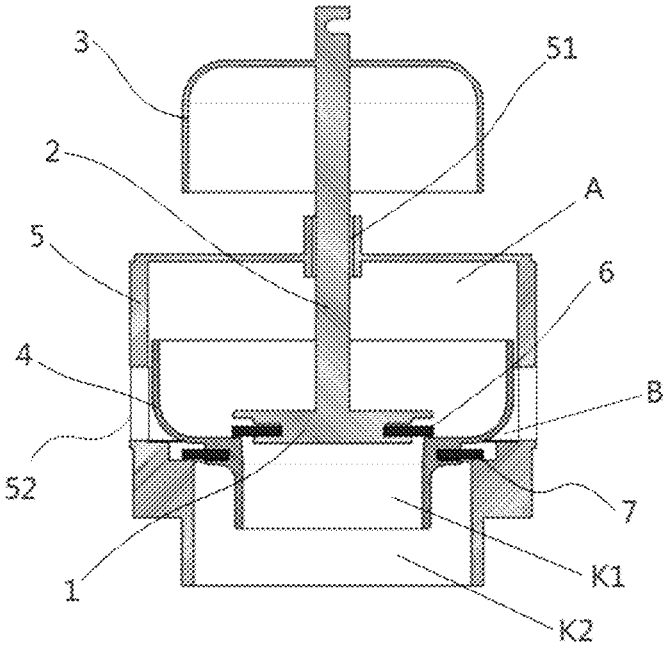
FIG. 1 is a structural view of a drain valve in the closed state in one preferred embodiment of the invention.

One preferred embodiment of the invention provides a drain valve. As shown in FIG. 1, the drain valve includes a valve body 5, a first valve element 4, a second valve element 1 and a lifting component 2, wherein a drain outlet K2 is formed in the lower portion of the valve body 5; the first valve element 4 is arranged in the valve body 5 and used to open or close the drain outlet K2, divides the valve body 5 into an inner cavity A and an outer cavity B, and is provided with a water outlet K1 communicated with the drain outlet K2; the second valve element 1 is located in the inner cavity A and used to open or close the water outlet K1 of the first valve element 4; and the lifting component 2 has an end connected to the second valve element 1 and is provided with a floating body 3, and with the assistance of the buoyancy force of the floating body 3, the lifting component 2 lifts the second valve element 1.

Through this configuration, the inner cavity is basically closed, so that when the drain valve is in a closed static state, the water pressure in the inner cavity is equal to the pressure outside the cavity.

Preferably, the first valve element 4 is a hollow part, and as long as the first valve element 4 can divide the interior of the valve body 5 into the basically-closed inner cavity A and the outer cavity B when moving upwards and downwards in the valve body 5, the first valve element 4 can be in various shapes such as a hollow taper shape, a bowl shape or a T shape.

Figure 2:
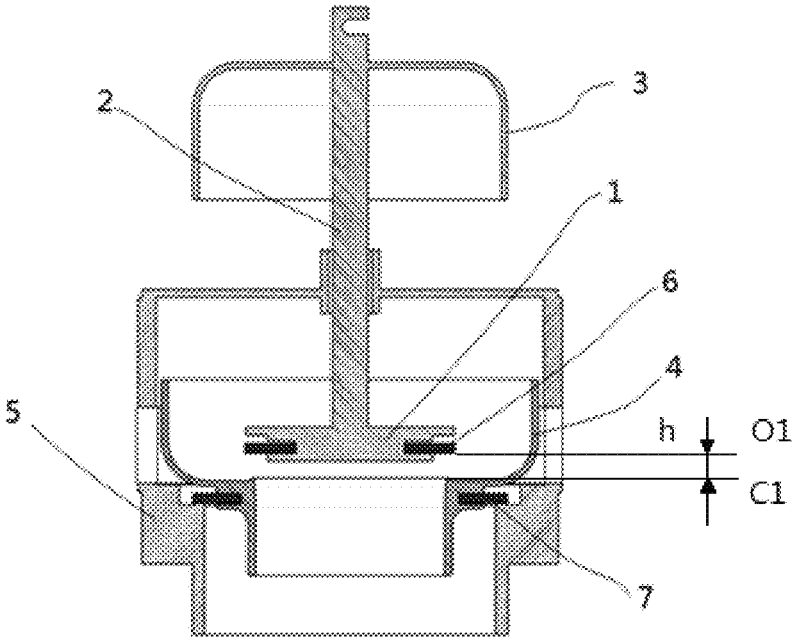
FIG. 2 is a structural view of the drain valve with a second valve element in the open state in the preferred embodiment of the invention.
Figure 3:
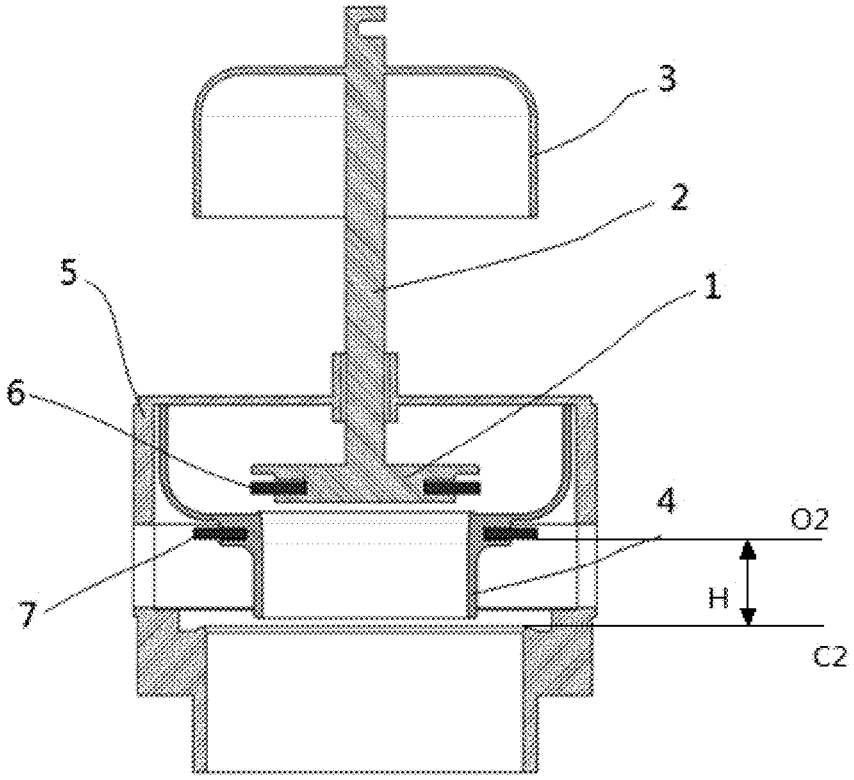
FIG. 3 is a structural view of the drain valve in the open state in the preferred embodiment of the invention.

As shown in FIG. 2, the lifting component 2 is lifted to drive the second valve element 1 to move to a first opening position O1 to open the water outlet K1 from a first closing position C1 for initially closing the water outlet K1, then water in the inner cavity A is discharged, the downward water pressure borne by the second valve element 1 is decreased accordingly, and thus, the second valve element 1 automatically rises to a limit height under the buoyancy force of the floating body 3. As shown in FIG. 3, when water in the inner cavity A is discharged, the downward water pressure borne by the first valve element 4 is also decreased, so that the first valve element 4 automatically floats upwards to a second opening position O2 to completely open the drain outlet K2 from a second closing position C2 for initially closing the drain outlet K2, and thus, water in the drain valve is discharged.

The maximum lift stroke h of the second valve element 1 from the first closing position C1 to the first opening position O1 is smaller than the maximum stroke H of the first valve element 4 from the second closing position C2 to the second opening position O2.

The side wall of the valve body 5 is provided with a drain window 52 through which water outside the valve body 5 is communicated with the outer cavity B of the valve body 5. When the first valve element 4 floats upwards to open the drain outlet K2, water outside the valve body 5 flows out of the drain outlet K2 via the drain window 52.

The inner cavity A is provided with a water supply channel allowing water outside the inner cavity to enter the inner cavity A.

Figure 5:
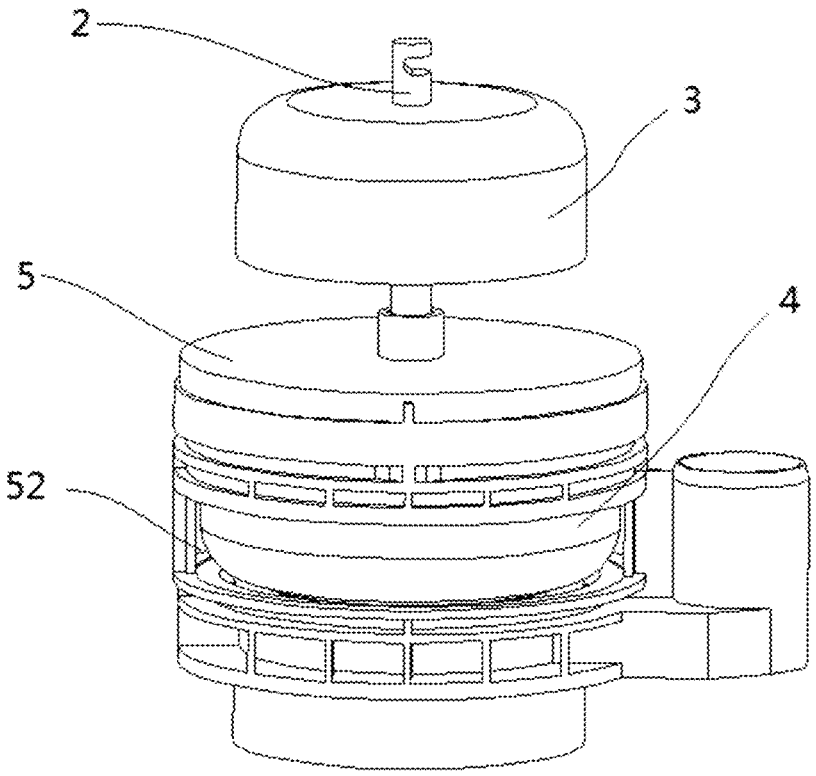
FIG. 5 is a perspective view of the drain valve in the preferred embodiment of the invention.

As shown in FIG. 1 and FIG. 5, the water supply channel is a gap between the first valve element 4 and the side wall of the valve body 5. Water outside the valve body 5 enters the outer cavity B of the valve body 5 via the drain window 52 and then enters the inner cavity A from the water supply channel.

The buoyancy force of the floating body is greater than the gravity of the lifting component and the second valve element in water and smaller than the resultant force of the gravity and water pressure borne by the lifting component and the second valve element when the water outlet is the closed state.

Through this configuration, on the one hand, when the drain valve is in the closed static state, the second valve element bears a downward resultant force of the upward buoyancy force of the floating body, the downward water pressure in the inner cavity, the gravity of the lifting component and the gravity of its own to close the water outlet, and the first valve element closes the drain outlet under the effect of the pressure in the inner cavity and the gravity of its own; when the second valve element is lifted to the first opening position, water in the inner cavity is rapidly discharged, and water in an external water tank passes through the drain window and the water supply channel to enter the inner cavity; and as the draining speed is much higher than the inflow speed, the pressure in the inner cavity is rapidly decreased, the downward force borne by the second valve element is drastically decreased accordingly, the buoyancy force of the floating body is greater than the gravity of the lifting component and the second valve element in water, and thus, the second valve element bears a large upward resultant force to automatically float upwards to a limit height. On the other hand, after the second valve element is opened, water in the inner cavity is rapidly discharged via the drain outlet, the water pressure, applied to the upper surface of the first valve element, in the inner cavity is rapidly decreased, the original balanced water pressure state of the inner cavity and the outer cavity is broken, and under the effect of an upward resultant force of the upward water pressure from the outer cavity and the buoyancy force, the first valve element overcomes the gravity of its own to automatically float upwards to open the drain outlet of the valve body and to reach the maximum opening height H. In this way, the lift stroke h for the first valve element to reach the set opening height H to open the drain outlet is much smaller than that of traditional drain valves (as for the lift stroke of the traditional drain valves, H=h), and thus, the drain valve can be used by users more conveniently.

In this embodiment, the floating body 3 is in a bowl shape open downwards.

Through this configuration, the floating body has a large buoyancy force in water under the effect of air left in a bowl-shaped inner cavity.

In this embodiment, the lifting component 2 is in a rod shape, the top of the valve body 5 is provided with a through hole 51, and the rod portion of the lifting component 2 stretches out of the through hole 51.

Figure 4:
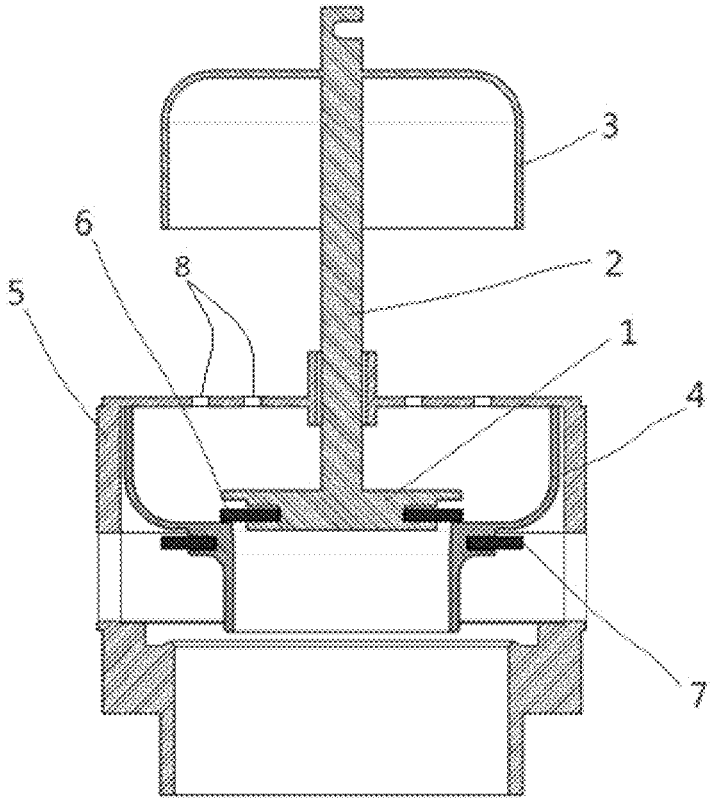
FIG. 4 is a structural view of the drain valve in the open state with the second valve element in the closed state in the preferred embodiment of the invention.

In this embodiment, the top of the valve body 5 is provided with a plurality of water holes 8 allowing water outside the valve body 5 to enter the inner cavity A, as shown in FIG. 4.

Through this configuration, the inflow speed of water outside the valve body into the inner cavity can be regulated. Water outside the valve body enters the inner cavity through the water supply channel as well as through the water holes and the through hole, matched with the rod-shaped lifting component, in the top of the valve body. The water supply speed to the inner cavity can be accordingly regulated by adjusting the number, size, distribution and the like of the water holes.

In this embodiment, H is 25 mm, and h is 8 mm.

As long as the drain outlet can be completely opened when the first valve element is lifted, the actual value of H can be adjusted according to the structural size of the drain valve. Similarly, the actual value of h can be adjusted by designers according to the structure of the drain valve.

A first sealing element 7 is arranged on the outer side wall of the first valve element 4 and used to seal the drain outlet K2. A second sealing element 6 is arranged on the outer side wall of the second valve element 1 and used to seal the water outlet K1.

In this embodiment, the first sealing element 7 and the second sealing element 6 are rubber gaskets.

Compared with traditional drain valves, the drain valve of the invention has the advantages of being short in effective lift stroke and convenient and fast to use.

The drain valve in this embodiment is placed in a water tank (not shown) when used. As shown in FIGS. 1-4 (FIG. 1 is a structural view of the drain valve in the closed state in the preferred embodiment of the invention), when the drain valve is in the closed state, the first valve element 4 and the second valve element 1 respectively close the corresponding drain outlet K2 and the corresponding water outlet K1. Particularly, the second valve element 1 seals the water outlet K1 in a liquid-tight manner under the effect of the upward buoyancy force of the floating body 3, the water pressure in the inner cavity A and the gravity of its own, and the first valve element 4 seals the drain outlet K2 in a liquid-tight manner under the effect of the pressure in the inner cavity A and the gravity of its own.

As shown in FIG. 2, when users start the lifting component 2 through an associated structure by pushing a button or turning a handle, the second valve element 1 overcomes the water pressure in the inner cavity A to upwards open the water outlet K1 by the stoke h under the dual effect of the lift force of the lifting component and the buoyancy force, and at this moment, water in the inner cavity A rapidly flows out via the water outlet K1. Along with the decrease of water in the inner cavity A, the pressure borne by the upper surface of the second valve element 1 is drastically decreased, and the second valve element 1 continues to move upwards to the limit height under the buoyancy force of the floating body 3.

As shown in FIG. 3, the lift stroke h of the second valve element 1 is about 8 mm. Meanwhile, along with the decrease of water in the inner cavity A and the gravity of the first valve element 4, the pressure borne by the first element 4 is decreased; however, the water pressure outside the inner cavity A is kept unchanged, the upward buoyancy force applied to the first valve element 4 is also kept unchanged, and thus, the first valve element 4 automatically floats upwards to open the drain valve under the effect of an upward resultant force, and water in the water tank flows out from the drain outlet K2 via the drain window 52. Afterwards, the first valve element 4 rises to the limit height. The actual opening stroke of the first valve element 4 is H, and H is about 25 mm.

As shown in FIG. 4, after the drain outlet K2 is opened, the water level in the water tank is gradually lowered, the buoyancy force applied to the lifting component 2 is decreased after the floating body 3 comes out of water, and when the buoyancy force applied to the second valve element 1 is smaller than the water pressure and gravity of the second valve element 1, the second valve element 1 starts to fall gradually till the water outlet K1 is closed. Water in the water tank passes through the water supply channel 52 and then enters the inner cavity A via a gap between the first valve element 4 and the valve body 5. Along with the increase of water in the inner cavity A, the pressure borne by the first valve element 4 is increased, and thus, the first valve element 4 moves downwards to close the drain outlet K2. Afterwards, the drain valve returns to the initial closed state, and a draining process is completed.

In another preferred embodiment of the invention, the top of the valve body 5 is provided with a plurality of circular water holes 8 allowing water outside the valve body 5 to enter the inner cavity A, as shown in FIG. 4.

Through this configuration, the inflow speed of water outside the valve body into the inner cavity can be regulated. Water in the outer cavity B enters the inner cavity through the water supply channel as well as through the water holes and the through hole, matched with the rod-shaped lifting component, in the top of the valve body. The water supply speed to the inner cavity can be accordingly regulated by adjusting the number, size, distribution and the like of the water holes.

In the above embodiments, the floating body is designed as a cylinder open downwards, but the invention is not limited to this design. For instance, the floating body can also be a box, a hollow floating ball, a floating box, solid polyester form or plastic, and the floating body can also be in a plate shape or a block shape. As long as the buoyancy force applied to the lifting component can be increased, the floating body can be designed according to requirements by those skilled in this field.

In the above embodiments, the first valve element is designed as a bowl, but the invention is not limited to this design. For instance, the first valve element can also be in a taper shape, a longitudinal T shape, a big-end-up step shape or any other shapes. In addition, the outer edge of the bowl-shaped first valve element can be provided with an extension part, which extends upwards or downwards, and an extremely narrow circular gap is formed between the outer circumferential surface of the extension part and the inner cavity of the first valve element. As long as the first valve element 4 can divide the interior of the valve body 5 into the basically-closed inner cavity A and the outer cavity B when moving upwards and downwards in the valve body 5 and can allow the second valve element 1 to smoothly move therein, the first valve element can be in any shapes.

Compared with traditional drain valves, the drain valve of the invention has the advantages being short in effective lift stroke and convenient and fast to use.

Those ordinarily skilled in this field would appreciate that the above embodiments are only specific embodiments of the invention. In actual application, various transformations of the invention can be made in forms and details without deviating from the spirit and scope of the invention.

What is claimed is:

1. A drain valve, including:

a valve body, wherein a drain outlet is formed in a lower portion of the valve body;

a first valve element, wherein the first valve element is arranged in the valve body and used to open or close the drain outlet, divides the valve body into an inner cavity and an outer cavity, and is provided with a water outlet communicated with the drain outlet;

a second valve element, wherein the second valve element is located in the inner cavity and used to open or close the water outlet of the first valve element; and a lifting component, wherein the lifting component has an end connected with the second valve element and is provided with a floating body, and with the assistance of a buoyancy force of the floating body, the lifting component lifts the second valve element;

wherein the lifting component is lifted to drive the second valve element to move to a first opening position to open the water outlet from a first closing position for initially closing the water outlet, then water in the inner cavity is discharged, a downward water pressure borne by the second valve element is decreased, and thus, the second valve element automatically rises to a limit height under the buoyancy force of the floating body, and when water in the inner cavity is discharged, a downward water pressure borne by the first valve element is also decreased, so that the first valve element automatically floats upwards to a second opening position to completely open the drain outlet from a second closing position for initially closing the drain outlet, and thus, water in the drain valve is discharged; and wherein a maximum lift stroke h of the second valve element from the first closing position to the first opening position is smaller than a maximum stroke H of the first valve element from the second closing position to the second opening position.

2. The drain valve according to claim 1, wherein the buoyancy force of the floating body is greater than a gravity of the lifting component and the second valve element in water and smaller than a resultant force of the gravity and water pressure borne by the lifting component and the second valve element when the water outlet is in a closed state.

3. The drain valve according to claim 1, wherein a side wall of the valve body is provided with a drain window through which water outside the valve body is communicated with the outer cavity of the valve body; and when the first valve element floats upwards to open the drain outlet, water outside the valve body flows out of the drain outlet via the drain window.

4. The drain valve according to claim 1, wherein the inner cavity is provided with a water supply channel allowing water outside the inner cavity to enter the inner cavity.

5. The drain valve according to claim 4, wherein the water supply channel is a gap between the first valve element and a side wall of the valve body, and water outside the valve body enters the outer cavity of the valve body via the drain window and then enters the inner cavity via the gap.

6. The drain valve according to claim 1, wherein the floating body is in a bowl shape open downwards or is made of light foam, the lifting component is in a rod shape, a top of the valve body is provided with a through hole, and a rod portion of the lifting component stretches out of the through hole.

7. The drain valve according to claim 4, wherein a top of the valve body is provided with a plurality of water holes allowing water outside the valve body to enter the inner cavity.

8. The drain valve according to claim 1, wherein H is 20-30 mm, and h is 4-10 mm.

9. The drain valve according to claim 1, wherein a first sealing element is arranged on an outer side wall of the first valve element and used to seal the drain outlet, a second sealing element is arranged on an outer side wall of the second valve element and used to seal the water outlet, and the first sealing element and the second sealing element are rubber gaskets.

* * * * *